US008038318B2

(12) United States Patent
Plunk

(10) Patent No.: US 8,038,318 B2
(45) Date of Patent: Oct. 18, 2011

(54) DOOR FRAME MOUNTED REFLECTOR SYSTEM FOR FLUORESCENT TROFFER

(75) Inventor: Carlton B. Plunk, Saltillo, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 356 days.

(21) Appl. No.: 12/436,304

(22) Filed: May 6, 2009

(65) Prior Publication Data

US 2009/0279297 A1 Nov. 12, 2009

Related U.S. Application Data

(60) Provisional application No. 61/050,883, filed on May 6, 2008.

(51) Int. Cl.
*F21V 21/04* (2006.01)

(52) U.S. Cl. ..... 362/235; 362/217.11; 362/225

(58) Field of Classification Search ..... 362/147, 362/148, 224, 225, 217.11, 235, 260, 311.01, 362/364, 367, 374
See application file for complete search history.

(56) References Cited

U.S. PATENT DOCUMENTS

| | | | | |
|---|---|---|---|---|
| 4,562,517 | A * | 12/1985 | Pankin | 362/147 |
| 5,172,976 | A * | 12/1992 | Bogdanovs | 362/374 |
| 6,367,955 | B1 * | 4/2002 | Rhee | 362/368 |
| 7,901,105 | B2 * | 3/2011 | Fowler et al. | 362/217.15 |
| 2003/0002280 | A1 * | 1/2003 | Paravantsos | 362/223 |

* cited by examiner

*Primary Examiner* — David V Bruce

(57) ABSTRACT

A door frame mounted reflector system for a fluorescent troffer is depicted. The fluorescent troffer incorporates the utilization of a troffer housing and hingedly affixed to the troffer housing is a door frame which has attached thereto optical reflectors, the optical reflectors including optionally first and second lenses on either side of the centrally aligned basket and first and second upwardly extending downlight reflectors which extend upward from the longitudinal edge of the door frame towards the top wall of the troffer housing but which are not affixed to the top wall of the troffer housing. These downlight reflectors cover irregularities on the interior top wall of the troffer housing while providing smooth illumination characteristics to the lenses and basket.

7 Claims, 7 Drawing Sheets

DOOR FRAME MOUNTED REFLECTOR SYSTEM FOR FLUORESCENT TROFFER

FIELD OF THE INVENTION

The present invention is directed towards a door mounted reflector system for a fluorescent troffer and particularly to a door mounted reflector system which utilizes a basket and corresponding lenses with associated door mounted downlight reflectors.

REVIEW OF THE PRIOR ART

Troffer systems for fluorescent lighting luminaires are fairly well known in which the fluorescent lamps are placed within the troffer housing and wherein the troffer housing acts as the downlight reflector for the troffer lighting system. In these instances, the troffer housing has an interior wall directly associated with the fluorescent lamps. Typically in such fluorescent troffers, the interior top wall acts as a downlight reflector and has a matte paint finish in order to provide quality downlight reflective characteristics. Other systems utilize installed reflective surfaces directly mounted to the troffer housing which provides downlight of the lumen output from the fluorescent lamps but also requiring installation of the reflectors directly to the troffer construction.

DETAILED DESCRIPTION OF THE PREFERRED EMBODIMENT

Figure 1A:
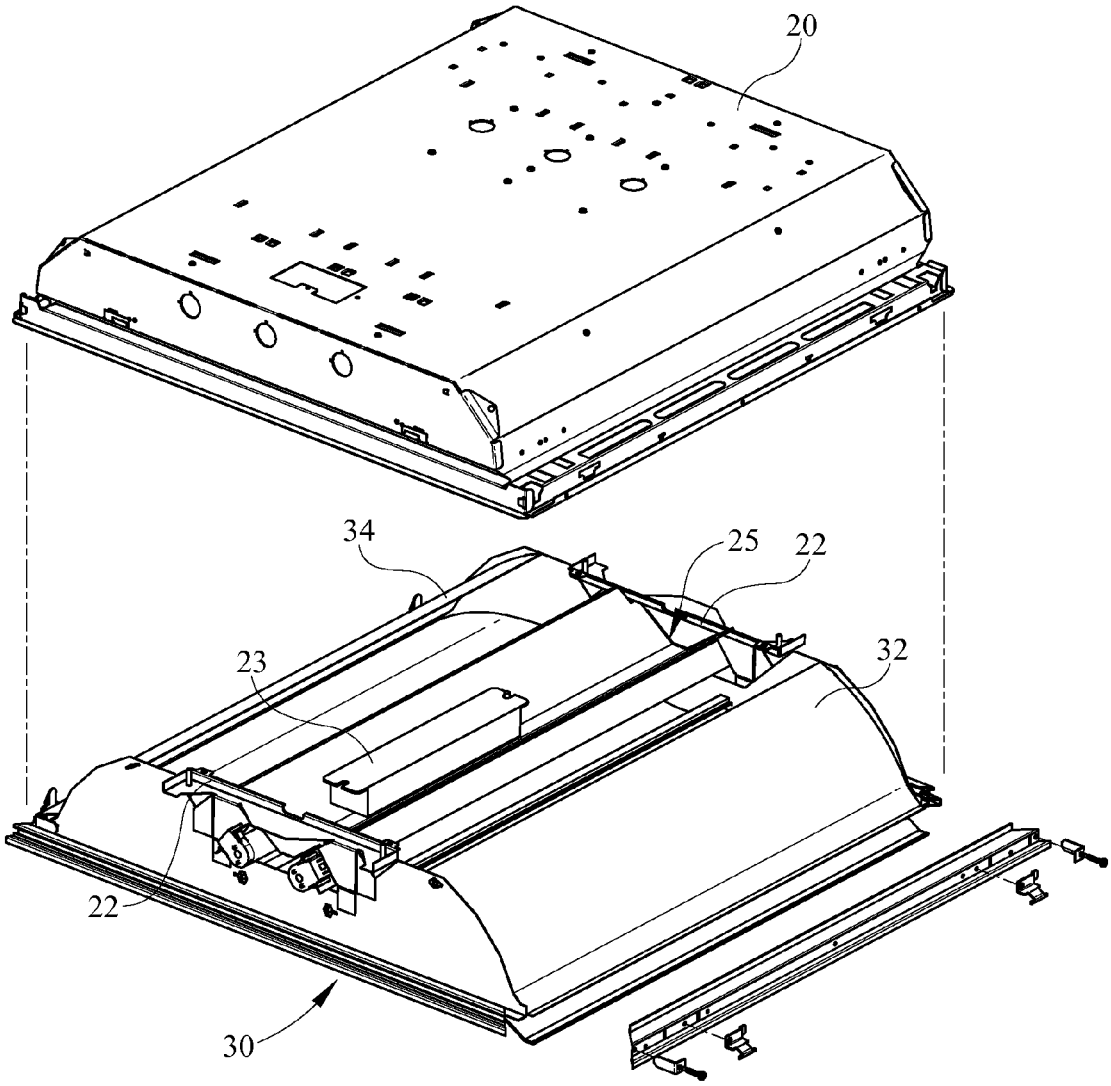
FIG. 1A discloses an exploded view of the door frame mounted reflector system for fluorescent troffer of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Turning to FIG. 1A, an exploded view of the door frame mounted reflector system for fluorescent troffers is depicted. In FIG. 1A, it is apparent that the troffer housing 20 which is separated from the remaining fixture in this disassembled view retains the door frame 30 thereon. The door frame 30 is shown in FIG. 1A supports the reflector system, the reflector system incorporating the frame end wall 37, the basket 33, first and second lens members 31 as well as the first and second downlight door reflectors 32 and 34. In the disassembled view of FIG. 1A, there are portions of the electronic assembly apparent even though they may be directly installed into the troffer housing 20. These are found in the electronic compartment 25 wherein the electronic end plate 22 on either side of the electronic compartment 25 are mounted directly to end walls of the troffer housing 20. Retained within the electronic compartment 25 is shown the ballast and other electronic wiring and control electronics which may be placed therein for proper functioning and operation of the lamps.

Figure 1B:
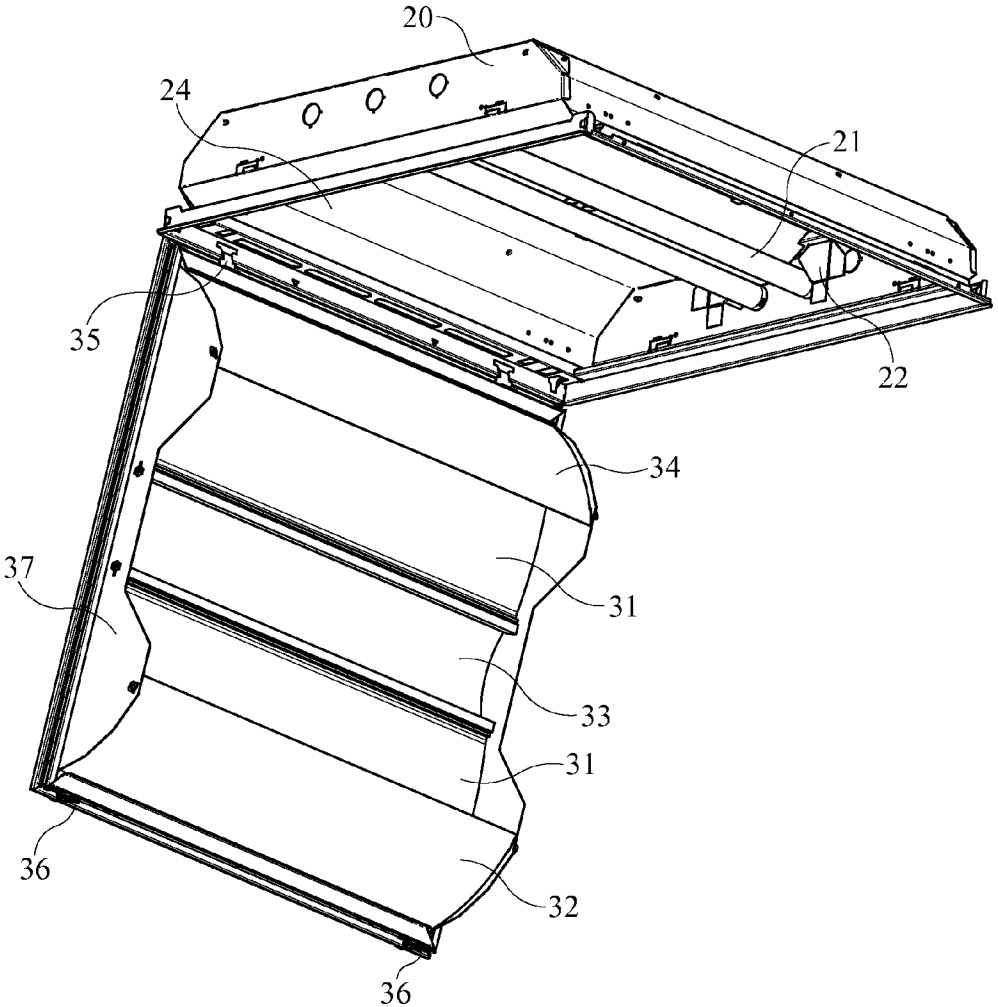
FIG. 1B discloses the door frame in an opened position for the reflector system of the present invention.

As can be seen in FIG. 1A and FIG. 1B, the door frame mounted reflector system of the present invention includes the door frame 30 which, as is shown in FIG. 1B depicts the door frame in the opened position providing access to the interior of the troffer housing 20 thereby providing access for relamping of the lamps 21 and also accessibility into the electronic compartment 25. Accessibility into the electronic compartment may be required with regards to replacement of the ballast 23 and other electronic compartment materials such as wiring and the like. Of interest with respect to FIG. 1B however is the hinged nature of the door frame 30 and the reflector system affixed thereto, the reflector system comprising the basket 33 and the first and second lenses 31 on opposing sides of the bucket along with first and second downlight door frame reflectors 32 and 34.

As may be understood in the art, common inexpensive downlight troffer housings incorporate the use of a matte finish on the interior walls of the troffer housing 20. It is common that these high cost matte finishing and paint increase the manufacturing costs and assembly time while also typically being utilized in deeper troffer housing constructions. In the design of the present invention, as is depicted in the various embodiments shown in the figures, a first and second lens 31 are provided with a centrally aligned basket 33, the basket being a lens or perforated metal as is known in the art. Curved lenses 31 may be translucent, transparent or frosted lenses as are known and available, the design of which provides a curved surface appearance reproducing looks of curved reflectors commonly found on direct and indirect products. As is also apparent from FIG. 1B, the door mounted assembly incorporates the utilization of a hinge 35 which may be a hinge mounted on either end of the frame. In other words, the latches 36 found on the door frame 30 act as the hinge members and allow the door frame to hinge from either end to provide access to the lamps and ballast assembly.

Returning to FIG. 1B, positioned above the first and second lens 31 are found first and second downlight door frame reflectors 32, 34. The door frame reflectors 32, 34 are positioned above the lenses 31 in order to provide downlight and reflective qualities from the interior optics of the fluorescent troffer and, in the present embodiment, extend upward from the door frame member 30 towards the top wall 24 of the troffer housing 20. As shown in FIG. 1B, the door frame has a frame end wall 37 which provides sufficient structure for mounting of the basket 33 as well as, if desired, upper attachment structure for the first and second door frame lens 32, 34.

Figure 4A:
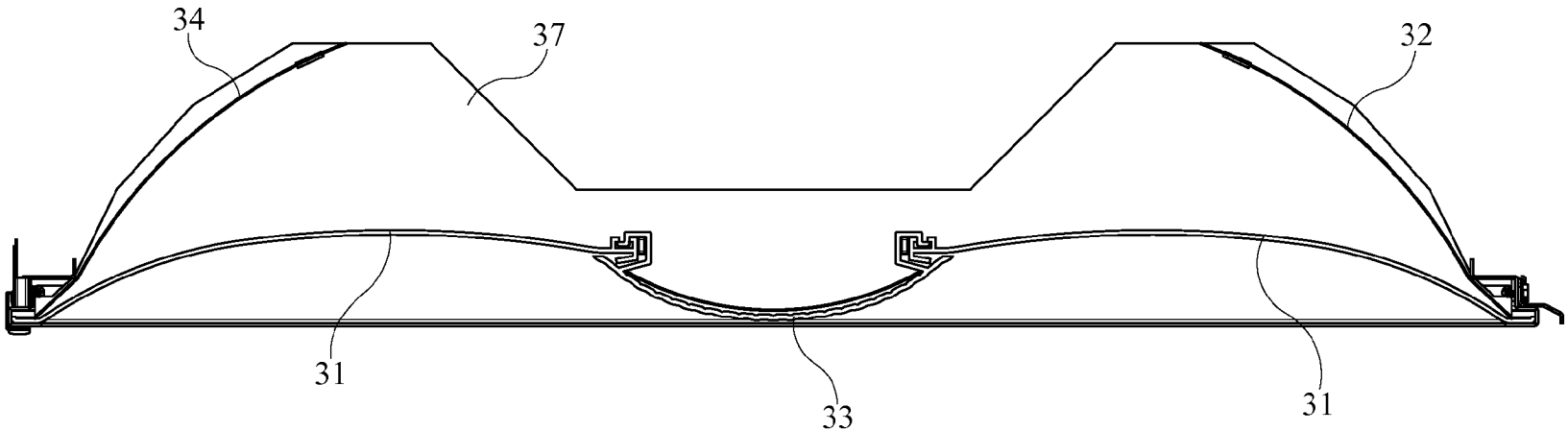
FIG. 4A is a side-sectional view of the reflector system of the present invention.
Figure 4B:
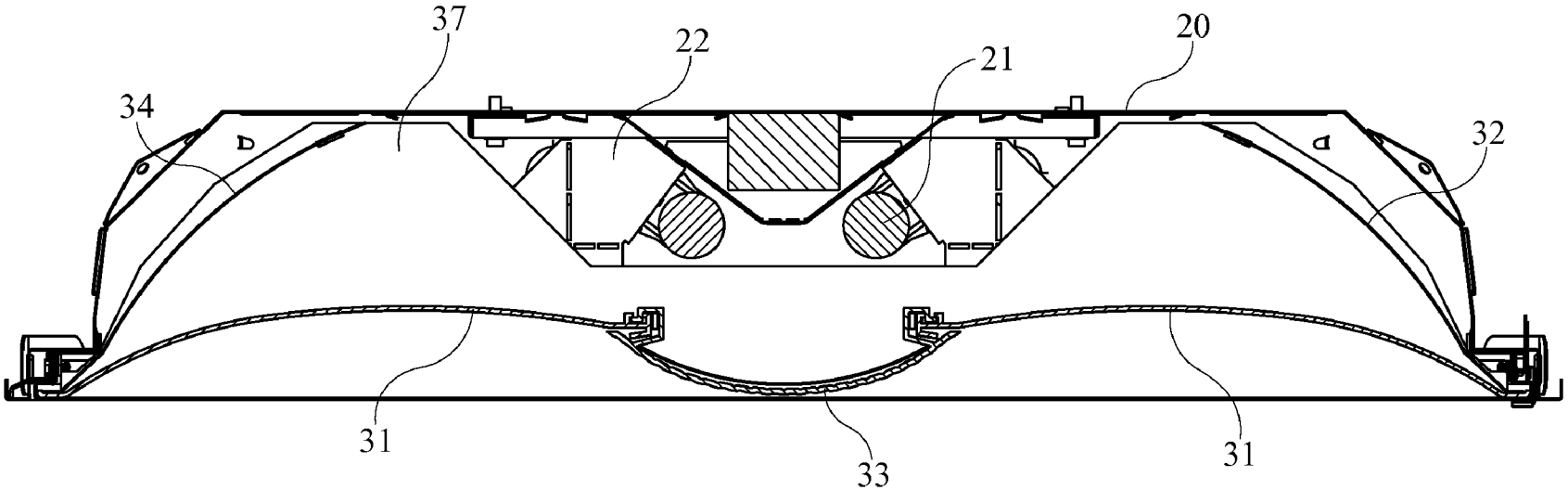
FIG. 4B is a side-sectional view of the reflector system of the fluorescent troffer of the present invention.

By positioning the door frame lens 32, 34 directly above both the lenses 31 and as can be seen particularly in FIG. 4B, it is unnecessary to treat the inner walls of the troffer housing 20 with costly finishes and paint materials and the like while also removing the requirement of direct installation of such structure directly to the troffer housing. Namely, irregularities formed in the recessed troffer housing 20 will not be visible to the user and will not provide reflective irregularities by utilizing such downlight reflectors as are shown.

Figure 2:
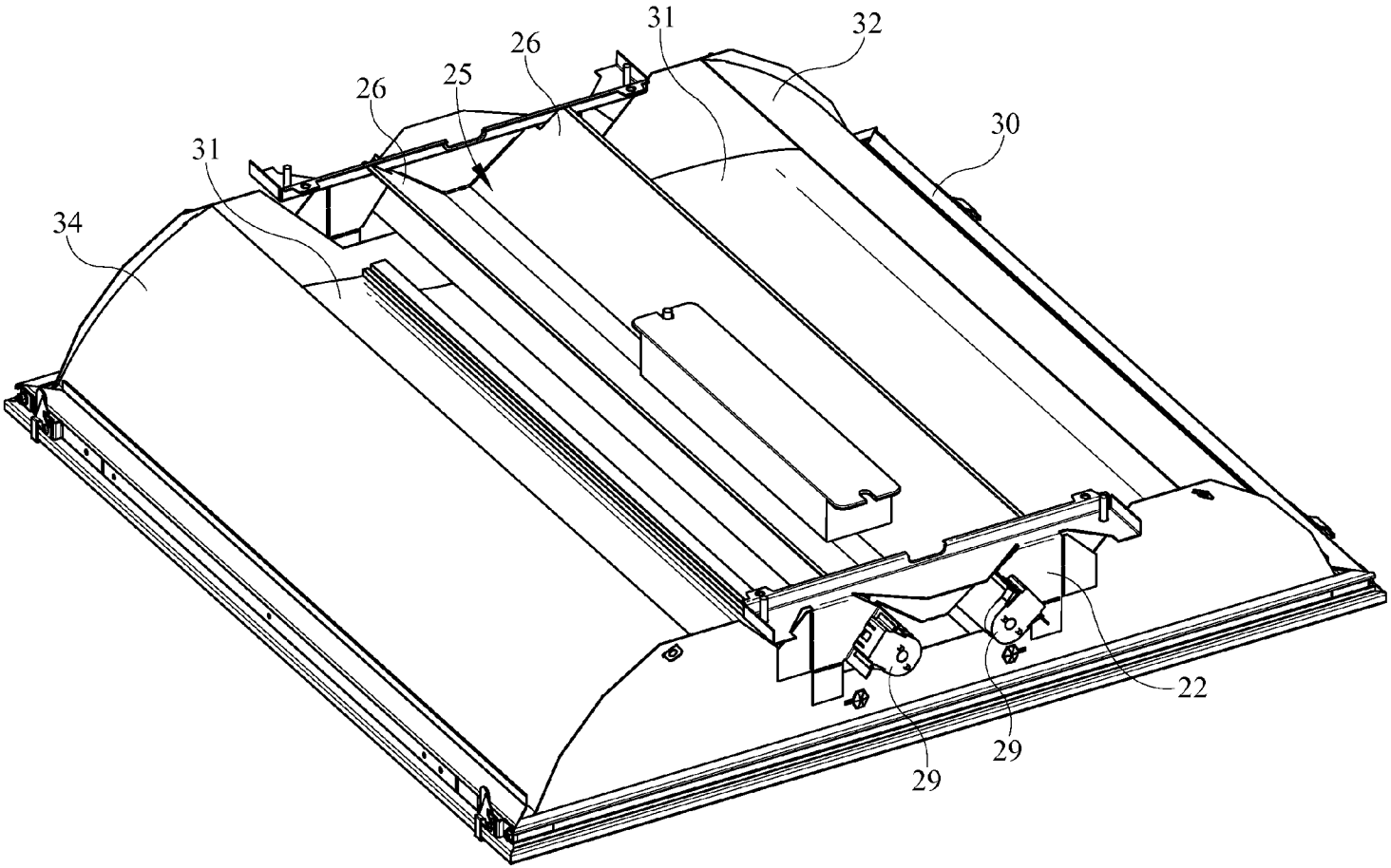
FIG. 2 is an assembled view of the reflector system of the present invention with the troffer housing removed.
Figure 3:
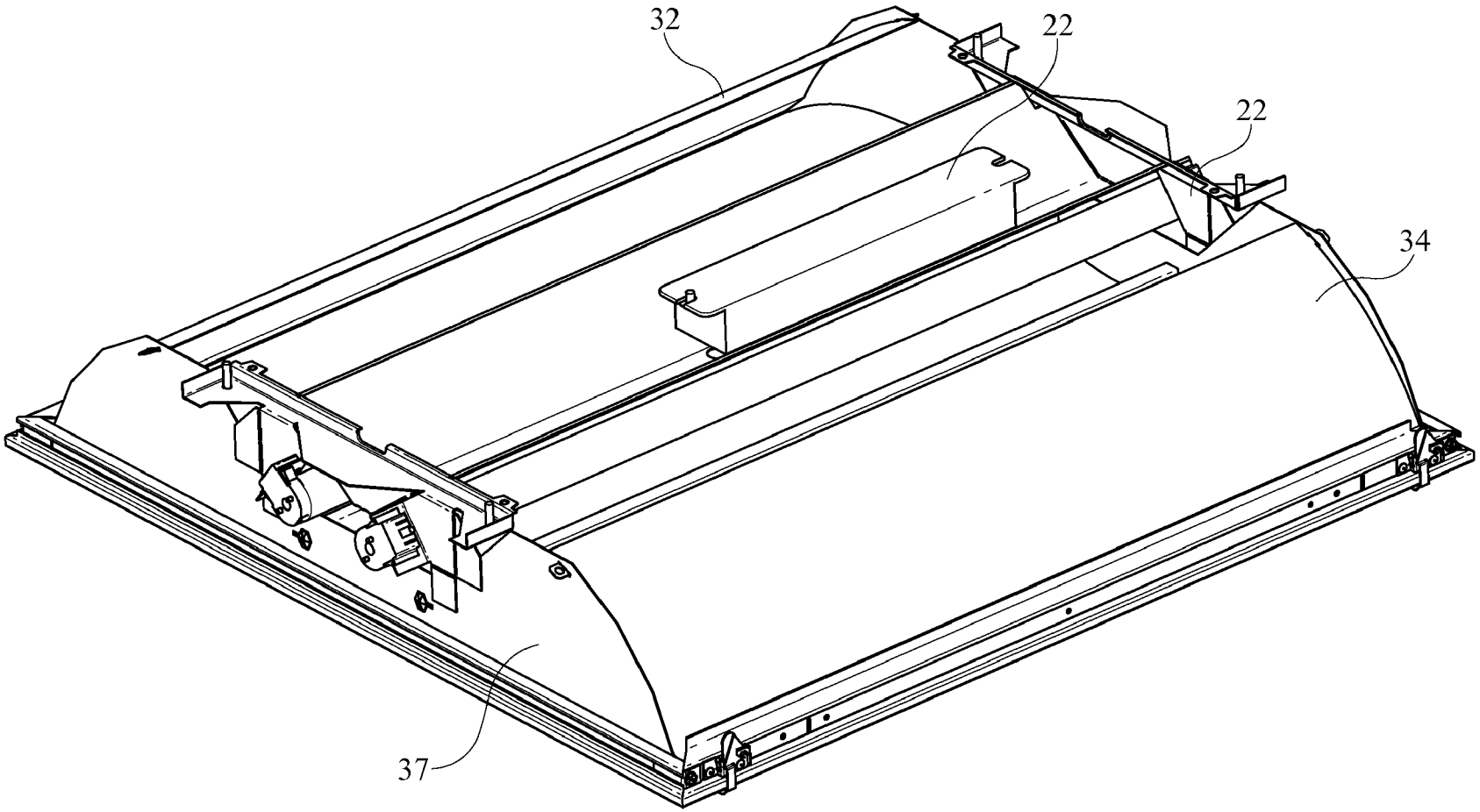
FIG. 3 is an upper perspective view of the reflector system of the present invention with the troffer system removed.

Turning to FIG. 2 and FIG. 3, the combined reflector assembly and electronic systems of the present troffer 20 is shown. As can be seen, first and second door frame reflectors 32, 34 are visible and attached to frame end walls 37, frame end walls 37 as may be seen from FIG. 4A, having a centrally aligned concave cutout portion to surround the end plates 22 which support the electronic housing and other lamp structure including lamp sockets 29. As may be seen, end plates 22 form the affixation methods for various structures including the V-shaped formation of the electronic compartment 25, both walls of which act as downlight reflectors 26 positioned above the lamps 21. Interior of the V-shaped compartment formed by the end plate 22 and downlight reflectors 26 is the electronic compartment 25 in which is positioned electronic material including the fluorescent ballast 23 and other wiring and electronics necessary to energize and control the fluorescent lamps and control the light thereof. As may be apparent, the V-shaped cutout formed in the frame end walls 37 surround the end plate 22 and allow the door frame 30 to be moved there around for installation of the door frame and reflector system into the troffer housing 20. As can also be seen in FIG. 2 and FIG. 3, the door frame reflectors 32, 34 are shown extending upward from the edges of the door frame upward toward the top wall 24 of the troffer housing 20 but are not affixed thereto. These door frame reflectors 32, 34 are secured at their lower ends as can be seen in FIG. 4A, directly to the door frame itself and are movable with the door frame about the hinge line 35 and are removable out of the troffer housing when the door frame 20 is unlatched and rotated about hinge line 35.

Turning to FIGS. 4A and 4B, it is apparent that the first and second door frame reflectors 32, 34 cover a substantial portion of the interior top wall 24 of the troffer housing 20 wherein the lamps 21 are mounted to the appropriate end plates 22 and the downlight reflectors 26 are positioned adjacent to the fluorescent lamps 21. The troffer downlight reflectors 26 are mounted to the interior of the troffer housing 20 and form a portion of the downlight reflective qualities and characteristics of the troffer and a small portion of the downlight coverage area of the interior of the troffer housing thereby minimizing cost and installation efforts. Remaining portions of the interior top wall of the troffer housing 20 are covered by the door frame reflectors 32 and 34 positioned above the lenses 31.

Figure 5:
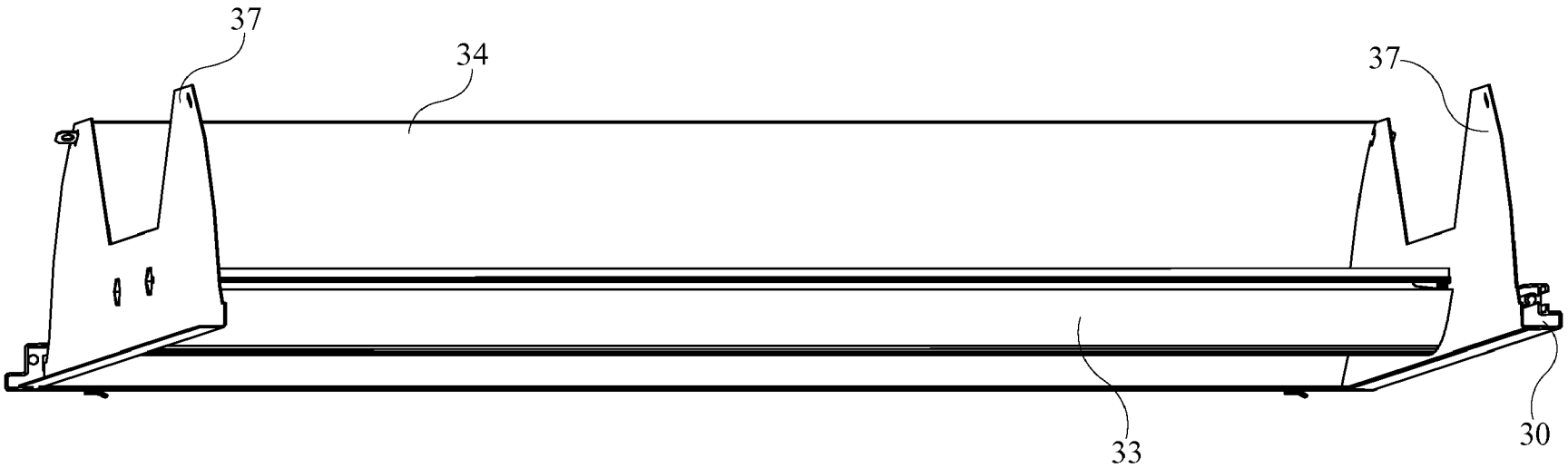
FIG. 5 is a roller perspective view of the section of the door frame mounted reflector of the present invention.

As a beneficial result of the design disclosed herein, the curved translucent lenses 31 appear with even illumination across their entire area due to the door frame lenses 32, 34 directly thereabove. By providing the door frame lenses 32, 34 in the position directly above the translucent lenses 31, smoother optical characteristics of the downlight may be achieved while also imperfections and irregularities in the housing causing shadowing or other negative visual illumination effects are prevented. Additionally, due to the smooth optical characteristics generated by such door frame lenses 32, 34 directly above the translucent lenses 31, much shallower troffer housings 20 may be utilized thus allowing light characteristics in deeper troffer housings to be generated in plenum housing installation constructions. Further, by reducing the inner volume of the troffer housing and utilizing reflective characteristics of the combination of the door reflectors 32, 34 and the lenses 31, shallower housing and more efficient utilization of the fluorescent lamps may be implemented while still providing soft natural lighting and reducing glare and imperfections in the reflective characteristics in the housing itself As may be seen from FIG. 5, the door frame reflector 34 may be mounted directly to the door frame 30 as is shown, the door frame 30 also supporting the frame end wall 37 to which is affixed the basket 33. By integrating reflective structure directly to the door frame 30 as is shown in the various embodiments and depictions, complete removal of the reflector system may be accomplished by merely opening the door for accessing the interior components of the fluorescent troffer.

In regards to the door frame and reflector system affixed to the door frame, the basket 33 extends across first and second sides of the door frame and has longitudinal edges on opposing sides, the longitudinal edges affixed to the first and second lenses 31 depicted in the figures. First and second lenses shown in the figures are depicted as being curved but obviously may be of any orientation in construction and are provided for transmitting, defusing and/or moderating light characteristics of the lamps reflected off of the downlight reflectors 26 and the first and second curved downlight reflectors 32, 34 which are affixed to the door frame. The curved door frame reflectors 32, 34 which are shown in the figures and in particular in FIG. 4B, tend to follow and extend upward from the door frame towards the top wall 24 of the troffer housing 20 and may be slightly curved or follow the curvature or structural formations of the troffer housing. As can be seen from the figures, curved downlight reflectors 32, 34 reflect light from the lamps 21 downward toward the lenses 31 and provide an even distribution of the light through the lenses 31. Additionally, such downlight reflectors provide smooth even illumination of the lenses 31 and can be modified to alter the visual characteristics of the luminaire based upon the material with which the downlight reflectors 32, 34 are provided. Standard reflector material such as highly anodized aluminum or any known reflective surfaces may be implemented in utilization of the downlight reflectors 32, 34.

As previously mentioned, the downlight reflectors are affixed to the lower door frame at one longitudinal edge thereof and extend upward towards the top wall of the troffer housing 20 but are not affixed thereto. Mechanisms for attachment of the reflectors 32, 34 directly to the door frame are known as long as affixation of the lens directly to the door frame or similar construction thereof in adjacent areas may be implemented. As was previously described, lenses 31 may be frosted, translucent or other desirable lens characteristics as are known in the art combined with the basket extending along first and second longitudinal edges of the first and second lens. Basket 33 may be perforated metal, translucent lens material or other desirable optical characteristics as may be implemented. As may be seen in construction of the attachment between the basket 33 and the dual lenses 31 in FIG. 4B, once the door frame 30 is latched to the troffer housing along the lower rim of the troffer housing as previously described, entry and access to the basket area is prevented.

Finally, as is shown in the various figures, electronic compartment area 25 may retain therein a number of electronic components, only the ballast 23 primarily shown in the various figures for understanding and representation. However, various electronic elements and components may also be included within such electronic retention area and the ballast as depicted may be mounted in such electronic retention area or may be affixed or retained in an adjacent remote area as desired by installation characteristics. Also, while the various embodiments depict latches 36 for affixation of the door frame to the lower edge of the troffer housing 20, any number of mechanical attachment mechanisms may be utilized in order to affix the edge of the door frame to the lower member of the troffer housing, wherein such affixation mechanism acts as both an attachment mechanism and a hinge only as a single latch style mechanism opposite a physical hinge. Such construction are well known in the art and the various attachment mechanisms available for utilization in similar troffer housings may be implemented and fall within the teachings and disclosures herein.

The foregoing description of structures and methods has been presented for purposes of illustration. It is not intended to be exhaustive or to limit the invention to the precise steps and/or forms disclosed, and obviously many modifications and variations are possible in light of the above teaching. It is understood that while certain forms of the low pressure forced air heater have been illustrated and described, it is not limited thereto except insofar as such limitations are included in the following claims and allowable functional equivalents thereof

The invention claimed is:

1. A recessed troffer and door frame reflector system, comprising:

a troffer housing with an electronic retaining area holding electronic components to energize and power a plurality of fluorescent lamps affixed within said housing;

a door frame hingedly affixed to a lower lip of said troffer housing, a first side of said door frame latched to said housing, a second opposing side of said door frame hinged to said housing lower lip;

said door frame retaining a central basket having a first and second longitudinal edge, said first longitudinal edge affixed to a first lens, said second longitudinal edge affixed to a second lens, said first lens, basket and second lens spanning across said door frame;

a first and second downlight reflector affixed to said door frame along co-adjacent edges of said first and second lens, said first and second downlight reflector extending upward from said door frame towards a top wall of said troffer housing and movable about said door frame hinge with said door frame.

2. The recessed troffer and door frame reflector system of claim 1 wherein said first and second downlight reflector are each affixed to a first and second door frame end wall extending upwardly from said door frame, said first and second downlight reflector affixed to said respective first and second end wall at a top edge.

3. The recessed troffer and door frame reflector system of claim 1 wherein said basket is a perforated metal basket and wherein said first and second lens are translucent lenses.

4. A recessed troffer and door frame reflector system, comprising:

a troffer housing having a top wall and depending side walls, said depending side walls terminating at a troffer edge, said troffer housing retaining a plurality of fluorescent lamps, said fluorescent lamps in electrical communication with a ballast;

a door frame hingedly affixed to said troffer along a first side, said door frame having an opposing side with at least one securing mechanism securing said door frame against said troffer, said door frame supporting a reflector system;

said door frame having at least one lens and basket spanning said door frame;

said door frame reflector system further including a first and a second downlight reflector extending upwardly from said door frame, said first and second downlight reflector affixed to said door frame covering at least a portion of an interior surface of said top wall when said door frame is affixed in a closed position to said troffer;

wherein said plurality of fluorescent lamps extend along a longitudinal axis within said troffer, said downlight reflectors movable about said hinge with said door frame extending concurrently along said longitudinal axis of said plurality of fluorescent lamps;

wherein each of said downlight reflectors have a lower edge, said lower edge of said first downlight reflector affixed along a first side of said door frame, said lower edge of said second downlight reflector affixed along a second side of said door frame, said first side and said second side of said door frame being opposing sides.

5. The recessed troffer and door frame reflector system of claim 4 wherein said first and second downlight lens each have an upper edge, said door frame having a frame end wall on opposing sides, said upper end of said reflectors affixed at a first side to said first frame end wall and at a second side to said second frame end wall.

6. The recessed troffer and door frame reflector system of claim 4 wherein said door frame supports a first and a second lens interposed on either side of a basket, said basket having a first and second longitudinal edge, said first longitudinal edge affixed to said first lens, said second longitudinal edge affixed to said second lens, said first lens, said basket and said second lens extending across said door frame.

7. A troffer and downlight reflector system, comprising:

a troffer housing having a top wall and depending side walls extending downward to a lower edge and further having a plurality of lamps;

a door frame hingedly affixed adjacent said lower edge of said troffer and mechanically attachable to said troffer, said door frame supporting a first and a second down light reflector extending upward from said door frame towards said troffer top wall, each of said down light reflectors covering a portion of the interior of said depending side walls of said troffer housing;

said first down light reflector in optical alignment with a first lamp, said second down light reflector in optical alignment with a second lamp;

said first and second down light reflectors extending upward from opposing sides of said door frame and towards said top wall and rotatable about said hinge with said door frame;

said door frame having at least one lens extending across said opposing sides of said door frame;

wherein said lens of said door frame is evenly illuminated by said lamps and said down light reflectors, said reflectors covering imperfections and down light irregularities from said troffer side walls.

* * * * *